US010393448B2

(12) United States Patent
Rondet

(10) Patent No.: US 10,393,448 B2
(45) Date of Patent: Aug. 27, 2019

(54) PLATE HEAT EXCHANGER

(71) Applicants: ALFA LAVAL CORPORATE AB, Lund (SE); ALFA LAVAL VICARB SAS, St. Egreve (FR)

(72) Inventor: Frédéric Rondet, Grenoble (FR)

(73) Assignees: ALFA LAVAL CORPORATE AB, Lund (SE); ALFA LAVAL VICARB SAS, St. Egreve (FR)

( * ) Notice: Subject to any disclaimer, the term of this patent is extended or adjusted under 35 U.S.C. 154(b) by 57 days.

(21) Appl. No.: 15/740,713

(22) PCT Filed: May 19, 2016

(86) PCT No.: PCT/EP2016/061257

§ 371 (c)(1),
(2) Date: Dec. 28, 2017

(87) PCT Pub. No.: WO2017/001111

PCT Pub. Date: Jan. 5, 2017

(65) Prior Publication Data

US 2018/0187975 A1 Jul. 5, 2018

(30) Foreign Application Priority Data

Jul. 1, 2015 (EP) ..... 15174725

(51) Int. Cl.
*F28F 3/08* (2006.01)
*F28D 9/00* (2006.01)
(Continued)

(52) U.S. Cl.
CPC ..... *F28D 9/005* (2013.01); *F28D 9/0012* (2013.01); *F28D 9/0043* (2013.01); *F28F 3/046* (2013.01);
(Continued)

(58) Field of Classification Search
CPC ..... F28D 9/005; F28D 9/0012; F28D 9/0043; F24F 3/1411; F28F 3/044; F28F 3/046;
(Continued)

(56) References Cited

U.S. PATENT DOCUMENTS 3,334,399 A * 8/1967 Teeguarden ..... B21D 53/04 165/166
3,548,929 A 12/1970 Gross
(Continued)

FOREIGN PATENT DOCUMENTS

CN 87 1 03478 A 11/1988
CN 101416013 A 4/2009
(Continued)

OTHER PUBLICATIONS

An English Translation of the Office Action (Notice of Reasons for Rejection) dated Nov. 19, 2018, by the Japanese Patent Office in corresponding Japanese Patent Application No. 2017-567722. (5 pages).
(Continued)

*Primary Examiner* — Davis D Hwu
(74) *Attorney, Agent, or Firm* — Buchanan Ingersoll & Rooney PC

(57) ABSTRACT

A plate heat exchanger comprising a casing, a fluid separation device, a number of heat transfer plates that are permanently joined to each other and have central openings that form a central space in a plate stack and in which the fluid separation device is arranged, such that a first part of the central opening may act as a fluid inlet and a second part of the central opening may act as a fluid outlet for a first fluid, opposite sides of the plates act fluid entries and exits for a second fluid, an outer dimension of the plate stack is smaller
(Continued)

(B-B)

than an inner dimension of a shell of the casing, wherein fluid blockers are arranged in a gap between the shell and the plate stack.

15 Claims, 4 Drawing Sheets

(51) Int. Cl.
*F28F 3/04* (2006.01)
*F28F 9/00* (2006.01)
*F28F 9/02* (2006.01)

(52) U.S. Cl.
CPC ..... *F28F 9/005* (2013.01); *F28F 9/026* (2013.01); *F28F 2230/00* (2013.01)

(58) Field of Classification Search
CPC ..... F28F 9/005; F28F 9/026; F28F 2230/00; B21D 53/02; B21D 53/04; F01K 25/02
USPC ..... 165/167
See application file for complete search history.

(56) References Cited

U.S. PATENT DOCUMENTS

| | | | | |
|---|---|---|---|---|
| 3,743,011 | A | 7/1973 | Frost | |
| 4,215,745 | A | 8/1980 | Tuckmantel | |
| 4,637,211 | A * | 1/1987 | White | F01K 25/02 60/650 |
| 4,778,005 | A | 10/1988 | Smith | |
| 5,540,274 | A | 7/1996 | Slocum et al. | |
| 6,170,568 | B1 | 1/2001 | Valenzuela | |
| 7,204,300 | B2 | 4/2007 | Kontu et al. | |
| 7,347,253 | B2 | 3/2008 | Tauren et al. | |
| 7,610,953 | B2 | 11/2009 | Mulder | |
| 8,453,721 | B2 | 6/2013 | Mathur et al. | |
| 2002/0000310 | A1 | 1/2002 | Cheadle | |
| 2003/0000688 | A1 | 1/2003 | Mathur et al. | |
| 2003/0145609 | A1 * | 8/2003 | Maisotsenko | F24F 3/1411 62/121 |
| 2008/0179049 | A1 | 7/2008 | Mathur et al. | |
| 2008/0301941 | A1 | 12/2008 | Anderson, Jr. et al. | |
| 2009/0090496 | A1 | 4/2009 | Blomgren | |
| 2010/0116477 | A1 | 5/2010 | Mulder | |
| 2011/0139400 | A1 | 6/2011 | Hallmann et al. | |
| 2011/0186276 | A1 * | 8/2011 | Casterton | B21D 53/02 165/173 |
| 2012/0285669 | A1 | 11/2012 | Blomgren | |
| 2013/0087317 | A1 * | 4/2013 | Papoulis | F28F 3/044 165/177 |
| 2013/0133866 | A1 | 5/2013 | Kinder et al. | |
| 2013/0277028 | A1 | 10/2013 | Heiniö et al. | |

FOREIGN PATENT DOCUMENTS

| | | | |
|---|---|---|---|
| CN | 202018225 | U | 10/2011 |
| CN | 103354893 | A | 10/2013 |
| DE | 26 39 371 | A1 | 3/1977 |
| EP | 2 002 193 | | 12/2008 |
| EP | 2 837 905 | A1 | 2/2015 |
| JP | 2009-532659 | A | 9/2009 |
| WO | WO 98/44305 | A1 | 10/1998 |
| WO | WO 2007/114777 | A1 | 10/2007 |
| WO | 2012/089927 | A2 | 7/2012 |

OTHER PUBLICATIONS

An English Translation of the First Office Action and Search Report dated Jan. 3, 2019, by the State Intellectual Property Office of People's Republic of China in corresponding Chinese Patent Application No. 201680039047.6. (7 pages).
"Brock Turbulators", Fuel Efficiency, LLC., pp. 36-39.
International Search Report (PCT/ISA/210) dated Jul. 8, 2016, by the European Patent Office as the International Searching Authority for International Application No. PCT/EP2016/061257.
Written Opinion (PCT/ISA/237) dated Jul. 8, 2016, by the European Patent Office as the International Searching Authority for International Application No. PCT/EP2016/061257.

* cited by examiner

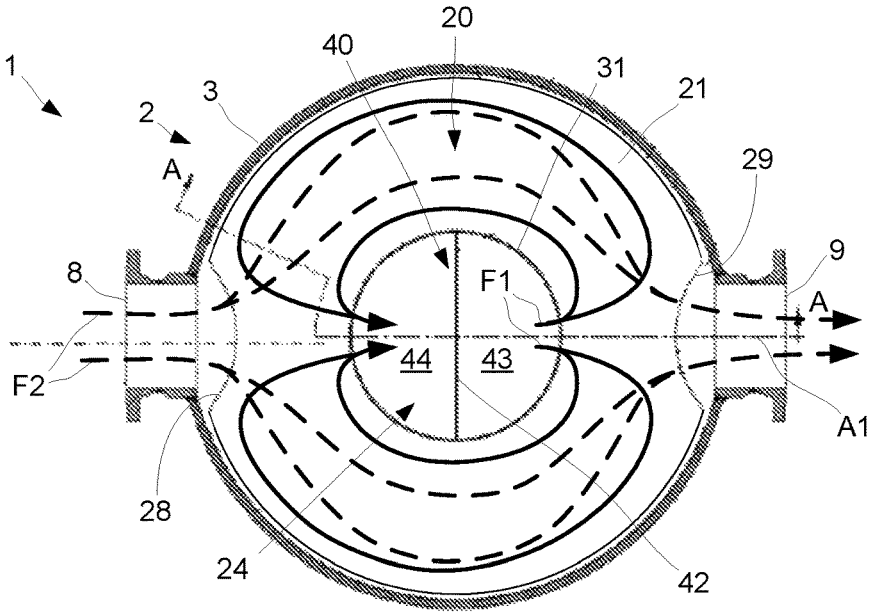
Fig. 1 (B-B)
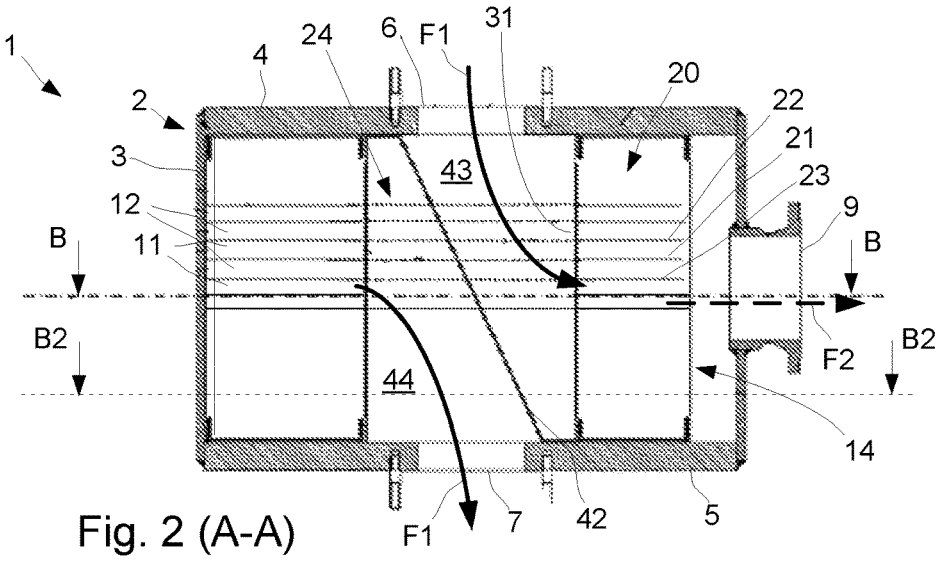
Fig. 2 (A-A)
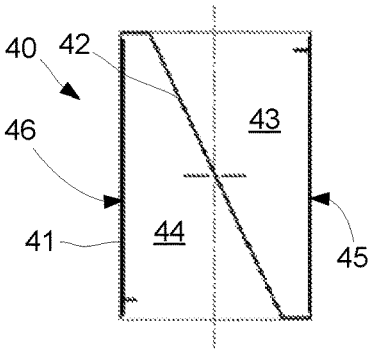
Fig. 3
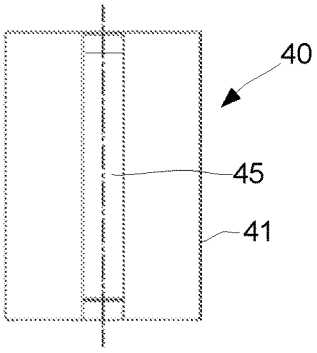
Fig. 4
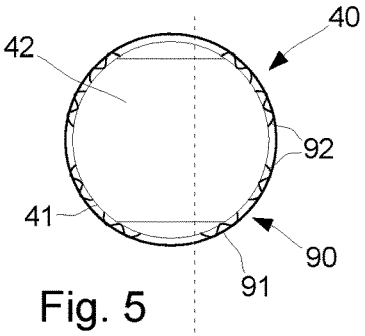
Fig. 5

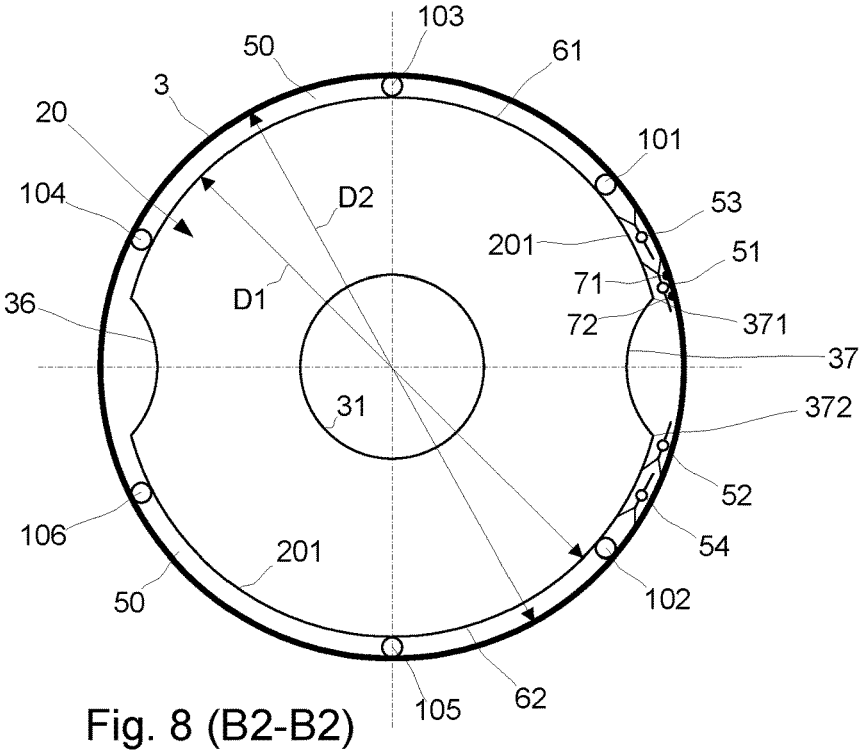
Fig. 8 (B2-B2)
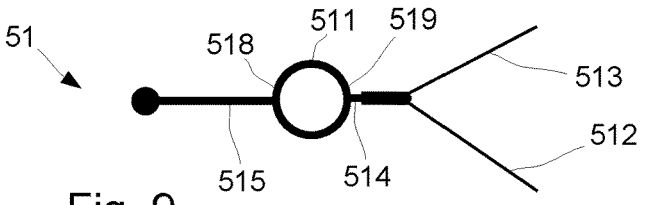
Fig. 9
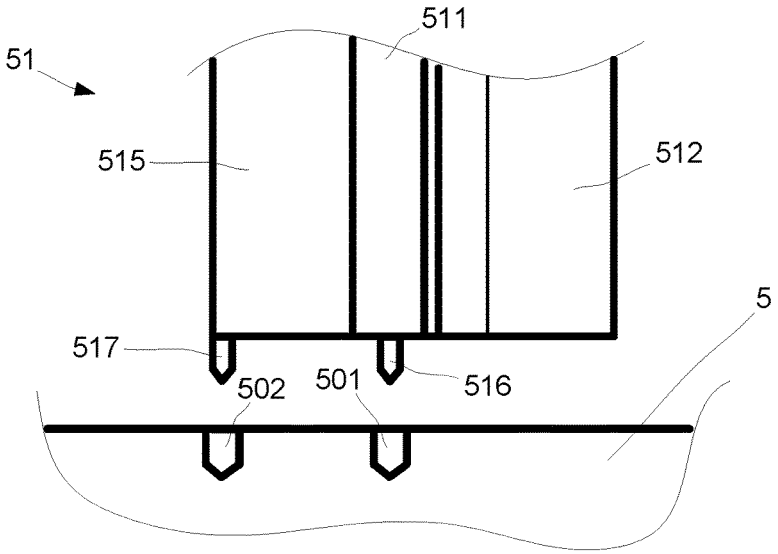
Fig. 10

PLATE HEAT EXCHANGER

TECHNICAL FIELD

The invention relates to a heat transfer plate of a type that has a central opening for receiving a fluid separation device that allows a first part of the central opening to act as a fluid inlet and a second part of the central opening to act as a fluid outlet.

BACKGROUND ART

Today many different types of plate heat exchangers exist and are employed in various applications depending on their type. Some types of plate heat exchangers are assembled from a casing that forms a sealed enclosure in which heat transfer plates that are joined are arranged. The heat transfer plates form a stack of heat transfer plates where alternating first and second flow paths for a first and a second fluid are formed in between the heat transfer plates.

For one type of plate heat exchangers, the so called central-port plate heat exchanger, each heat transfer plate has a central opening (central port) for the first fluid path. Fluid in the first fluid path enters a heat transfer plate at an inlet section of the central opening in the heat transfer plate, flows across the plate and leaves the plate at an outlet section of the same central opening. The outlet section is opposite the inlet section and a fluid separation device is inserted in the central opening for separating the fluid flow to the inlet section from the fluid flow from the outlet section. Thus, the same port is, by virtue of the separation device, used both as a fluid inlet and a fluid outlet for a fluid that flows over the heat transfer plate. Basically, the first fluid makes a 180° turn over the heat transfer plate, such that the first fluid leaves the plate at a location that is, as seen across the central opening, opposite the location where the first fluid entered the plate.

The second fluid enters the heat transfer plate at an inlet section of a periphery of the plate, flows across the plate and leaves the plate at an outlet section of a periphery of the plate, which outlet section is opposite the inlet section.

Obviously, the inlet and outlet for the first fluid are located between every second pair of plates while the inlet and outlet for the second fluid are located between every other, second pair of plates. Thus, the first and second fluid flows over a respective side of a heat transfer plate, in between every second pair of heat transfer plates. The plates of a plate pair that have an inlet and an outlet for the first fluid are sealed to each other along their entire peripheries while the plates of a plate pair that have an inlet and outlet for the second fluid are sealed to each other at their central openings.

Since the heat transfer plates are surrounded by the casing, the central-port plate heat exchanger may withstand high pressure levels in comparison with many other types of plate heat exchangers. Still, the central-port plate heat exchanger is compact, it has good heat transfer properties and may withstand hard operation conditions without breaking.

The joined heat transfer plates are sometimes referred to as a plate pack or a stack of heat transfer plates. The stack of heat transfer plates has a substantially cylindrical shape with an internal, central through hole that is characteristic for the central-port plate heat exchanger. The stack of heat transfer plates may be all-welded such that rubber gaskets may be omitted between heat transfer plates. This makes the central-port plate heat exchanger suitable for operation with a wide range of aggressive fluids, at high temperatures and at high pressures.

During maintenance of the central-port plate heat exchanger, the stack of heat transfer plates may be accessed and cleaned by removing e.g. a top or bottom cover of the shell and by flushing the stack of heat transfer plates with a detergent. It is also possible to replace the stack of heat transfer plates with a new stack that may be identical to or different from the previous stack as long as it is capable of being properly arranged within the shell.

Generally, the central-port plate heat exchanger is suitable not only for use as a conventional heat exchanger but also as a condenser or reboiler. In the two latter cases the shell may comprise additional inlets/outlets for a condensate, which may eliminate the need for a special separator unit.

The design of the central-port plate heat exchanger with its stack of heat transfer plates provides, as indicated, a combination of advantages and properties that are quite specific for the type. A number of embodiments of central-port plate heat exchangers have been disclosed, such as those found in patent document EP2002193A1. In comparison to several other types of plate heat exchangers, the central-port plate heat exchanger has a compact design and handles the flow of fluids well. However, it is estimated that the central-port plate heat exchanger may be improved in respect of its capability to more optimally direct the flow of fluids within the heat exchanger when it is operated, which would increase the thermal efficiency.

SUMMARY

It is an object of the invention to provide improved thermal efficiency of a central-port plate heat exchanger. In particular, it is an object to improve the flow of fluids within the heat exchanger.

To solve these objects a plate heat exchanger is provided. The plate heat exchanger comprises: a casing that comprises a shell, and a top cover and a bottom cover that are connected to the shell to from an enclosure in the casing; a fluid separation device; and a number of heat transfer plates that are joined to each other to form a plate stack that is arranged within the enclosure and has alternating first and second flow paths for a first fluid and a second fluid in between the heat transfer plates. The heat transfer plates have: central openings that form a central space in the plate stack and in which the fluid separation device is arranged, such that a first part of the central opening may act as a fluid inlet and a second part of the central opening may act as a fluid outlet for the first fluid; and first sides that act as a fluid entries for the second fluid, and second sides that are opposite the first sides and act as fluid exits for the second fluid. An outer dimension of the plate stack is smaller than an inner dimension of the shell, such that a gap is formed between the shell and the plate stack, and a first fluid blocker and a second fluid blocker are arranged in the gap between the shell and the plate stack, for reducing a flow of the second fluid in the gap.

The gap is required for obtaining efficient manufacturing when installing the plate stack in the heat exchanger, and the fluid blockers effectively prevents the second fluid from taking shortcuts past the heat transfer plates. This increases the thermal efficiency of the plate heat exchanger. Still other objectives, features, aspects and advantages of the invention will appear from the following detailed description as well as from the drawings.

BRIEF DESCRIPTION OF THE DRAWINGS

Embodiments of the invention will now be described, by way of example, with reference to the accompanying schematic drawings, in which FIG. 1 is a cross-sectional top view of a central-port plate heat exchanger, as seen along line B-B in FIG. 2, FIG. 2 is a cross-sectional side view of the heat exchanger of FIG. 1, as seen along line A-A in FIG. 1, FIG. 3 is a cross-sectional side view of a flow divider that is arranged in the heat exchanger of FIG. 1, as seen from a first side, FIG. 4 is a side view of the flow divider of FIG. 3, as seen from a second side, FIG. 5 is a top view of the flow divider of FIG. 3, as seen with a gasket arrangement, FIG. 8 is a cross-sectional top view of a central-port plate heat exchanger, as seen along line B2-B2 in FIG. 2, showing fluid blockers and guiders, FIG. 9 is a top view a fluid blocker shown in FIG. 8, FIG. 10 is a partial side view the fluid blocker of FIG. 9, including a section of a heat exchanger bottom cover.

DETAILED DESCRIPTION

Figure 6:
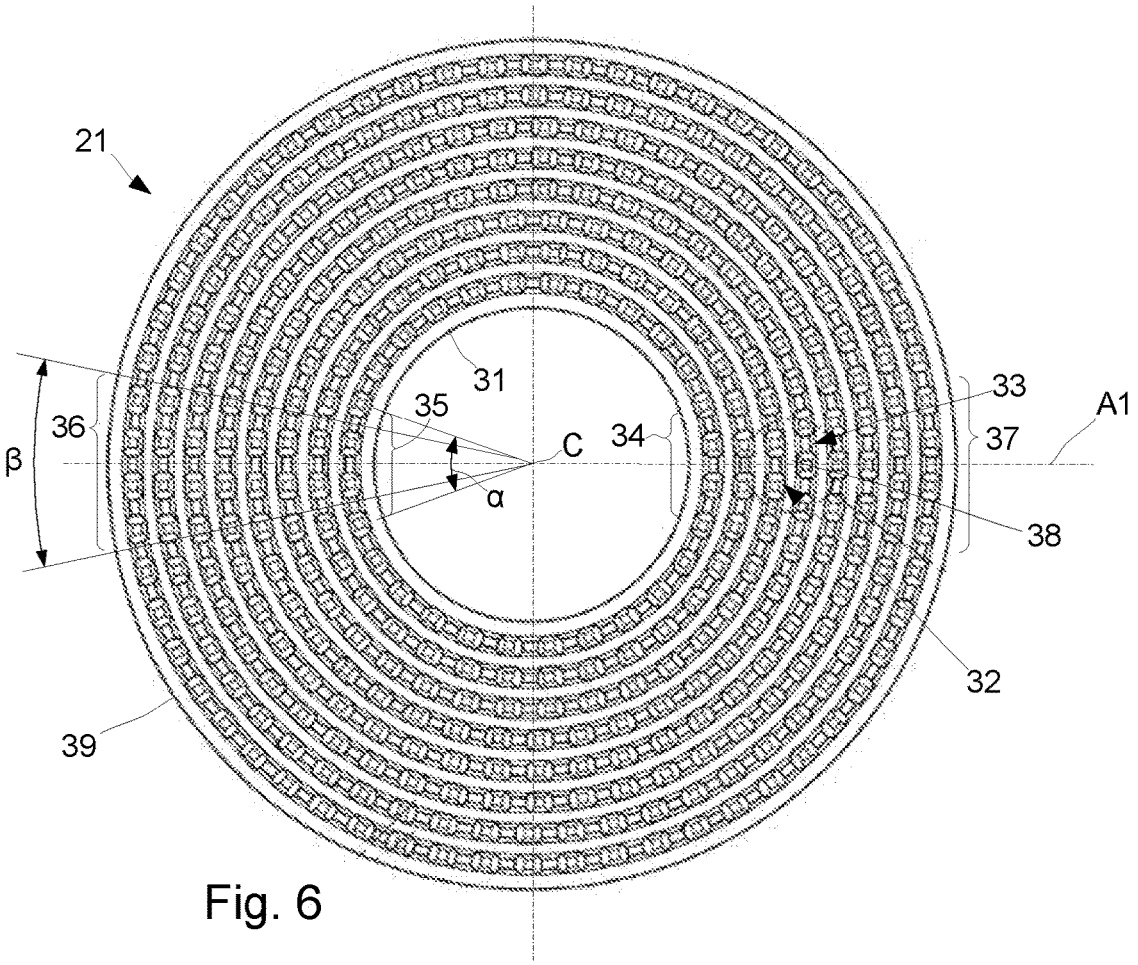
FIG. 6 is a principal top view of a heat transfer plate that together with similar heat transfer plates may form a plate stack for the heat exchanger of FIG. 1.

With reference to FIGS. 1 and 2 a central-port plate heat exchanger 1 is illustrated. The heat exchanger 1 has a casing 2 that comprises a cylindrical shell 3, a top cover 4 and a bottom cover 5. The top cover 4 has the shape of a circular disc and a periphery of the top cover 4 is attached to an upper edge of the cylindrical shell 3. The bottom cover 5 has the shape a circular disc and a periphery of the bottom cover 5 is attached to a lower edge of the cylindrical shell 3. The covers 4, 5 are in the illustrated embodiment welded to the cylindrical shell 3. In another embodiment the covers 4, 5 are attached to the cylindrical shell 3 via bolts that engage flanges (not shown) of the cylindrical shell 3 and the covers 4, 5. A number of heat transfer plates 21, 22, 23 that are permanently joined to each other form a plate stack 20 that is arranged within in an enclosure 14 within the casing 2. The stack 20 has, in between the heat transfer plates 21, 22, 23, alternating first and second flow paths 11, 12 for a first fluid F1 and for a second fluid F2, i.e. the first fluid F1 flow in between every second pair of heat transfer plates.

The top cover 4 has a fluid inlet 6 for the first fluid F1 which passes through the heat exchanger 1 via the first flow path 11. This fluid inlet 6 is referred to as a first fluid inlet 6. The bottom cover 5 has a fluid outlet 7 for the first fluid F1 that passes through the heat exchanger 1 via the first flow path 11. This fluid outlet 7 is referred to as a first fluid outlet 7. The first fluid inlet 6 is located at a center of the top cover 4 and the first fluid outlet 7 is located at a center of the bottom cover 5. Thus, the first fluid inlet 6 and the first fluid outlet 7 are located opposite each other in the casing 2.

The cylindrical shell 3 has a fluid inlet 8 for the second fluid F2 which passes through the heat exchanger 1 via the second flow path 12. This fluid inlet 8 is referred to as a second fluid inlet 8. The cylindrical shell 3 also has a fluid outlet 9 for the second fluid F2 that passes through the heat exchanger 1 via the second flow path 12. The outlet 9 is referred to as a second fluid outlet 9. The second fluid inlet 8 is located on a side of the cylindrical shell 3, midway between the upper edge of the cylindrical shell 3 and the lower edge of the cylindrical shell 3. The second fluid outlet 9 is located on a side of the cylindrical shell 3 that is opposite the second fluid inlet 8, midway between the upper edge of the cylindrical shell 3 and the lower edge of the cylindrical shell 3.

The casing 2, i.e. in the illustrated embodiment the cylindrical shell 3, the top cover 4 and the bottom cover 5, forms the enclosure 14 or an interior space 14 in which the stack 20 of heat transfer plates is arranged. The heat transfer plates in the stack 20, such as heat transfer plates 21, 22 and 23, are permanently joined and arranged in the sealed enclosure such that the first and second flow paths 11, 12 flow in respective, alternating flow paths in between the heat transfer plates. Each of the heat transfer plates in the stack 20 has a central opening 31. The central openings of several heat transfer plates in the stack 20 form together a central space 24 in the stack 20.

With further reference to FIGS. 3 and 4, a fluid separation device 40 is inserted into the central space 24 in the stack 20. The separation device 40 has the form of a cylinder 41 that fits close to central openings 31 of the heat transfer plates 21, 22, 23 in the stack 20. The height of the separation device 40 is the same as the height of the central space 24 in the stack 20. A flow divider 42 extends diagonally from an upper part of the cylinder 41 to a lower part of the cylinder 41 and separates the interior of the cylinder 41 into a first cylinder section 43 and a second cylinder section 44. The flow divider 42 separates the first cylinder section 43 from second cylinder section 44, such that fluid do not (apart for some leakage, if this occurs) flow directly between the cylinder sections 43, 44. Instead, fluid flows from the first cylinder section 43 to the second cylinder section 44 via the heat transfer plates in the stack 20.

The separation device 40 has a first opening 45 in the first cylinder section 43 and a second opening 46 in the second cylinder section 44. The first opening 45 is arranged opposite the second opening 46 with the flow divider 42 symmetrically arranged between the openings 45, 46.

With reference to FIG. 5 the heat exchanger 1 has a gasket arrangement 90 that is arranged between the fluid separation device 40 and the central openings 31 of the heat transfer plates 21-23. The gasket arrangement 90 has a cover sheet 91 that is arranged around the fluid separation device 40, such that a periphery of the fluid separation device 40 is, apart from the first and second openings 45, 46 in the fluid separation device 40, covered by the cover sheet 91. Generally, the cover sheet 91 is given the same shape as the cylinder 41, with openings that match to and are aligned with the openings 45, 46 in the cylinder 41, but is given a larger diameter so that the cover sheet 91 may be arranged around the cylinder 41. A small gap is then located between the cylinder 41 and the cover sheet 91. Corrugated metal sheets 92 are symmetrically arranged around the cylinder 41, in the gap between the cover sheet 91 and the cylinder 41. The corrugated metal sheets 92 are flexible and have a width that is larger than the gap between the cylinder 41 and the cover sheet 91, i.e. they fix the cover sheet 91 relative the cylinder 41 while allowing the cover sheet 91 to flex in the radial direction of the cylinder 41. The fluid separation device 40 can then be snugly fit into the central openings 31 of the heat transfer plates 21-23, such that the gasket arrangement 90 provides a sealing effect between the fluid separation device 40 and the central openings 31 of the heat transfer plates 21-23.

With reference to FIG. 6 one of the heat transfer plates 21 that is used for the stack 20 is shown. The heat transfer plate 21 has a central opening 31 and a number of rows 32, 33 with alternating ridges and grooves. Flat plate sections 38 separate the rows 32, 33 from each other. The heat transfer plate 21 has a central opening 31 that, together with central openings of other heat transfer plates in the stack 20, forms the central space 24 in the plate stack 20 and in which the fluid separation device 40 is arranged. Then a first part 34 of the central opening 31 acts as a fluid inlet 34 for the first fluid F1 and a second part 35 of the central opening 31 acts as a fluid outlet 34 for the first fluid F1. The first opening 45 of the separation device 40 faces the fluid inlet 34 and the second opening 46 of the separation device 40 faces the fluid outlet 46.

The inlet 34 allows the first fluid F1 to enter spaces in between every second heat transfer plate and the outlet 35 allows the fluid to exit the same spaces in between every second heat transfer plate. The outlet 35 is, as seen across a center C of the heat transfer plate 21, located opposite the inlet 34. The heat transfer plate 21 has also a first side 36 that acts as a fluid entry for the second fluid F2, and a second 37 side that acts as a fluid exit 37 for the second fluid F2. The fluid exit 37 is arranged opposite the fluid entry 36. All heat transfer plates in the stack 20 may have the form of the heat transfer plate 21 shown in FIG. 6, with every other heat transfer plate turned 180° around an axis A1 that extend along a plane of the heat transfer plate and though the center C of the heat transfer plate.

Figure 7:
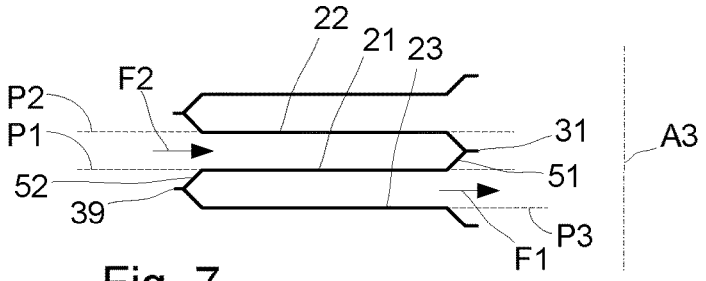
FIG. 7 is a principal cross-sectional side view of four heat transfer plate of the kind shown in FIG. 5.

With further reference to FIG. 7 a principal view of three heat transfer plates 21, 22, 23 are shown together with a further heat transfer plate, along a cross section that extends from the center C of the heat transfer plate 21 to a peripheral edge (periphery) 39 of the heat transfer plate 21. The periphery 39 of the heat transfer plate 21 is along its full length joined with a corresponding periphery of the lower heat transfer plate 23. The plates 22, 23 have central planes P2, P3 that correspond to a central plane P1 of plate 21. The interspace between the plates 21, 22 forms part of the first flow path 12 for the second fluid F2. The central plane P1 extends through the heat transfer plate 21, in parallel to the top surface (seen in FIG. 6) and the bottom surface of the heat transfer plate 21.

The heat transfer plate 21 may be partly joined with the upper heat transfer plate 22 at the central opening 31 of the heat transfer plate 21, i.e. the central opening 31 of the heat transfer plate 21 is partly joined with a similar central opening of the upper heat transfer plate 22. The central opening 31 of the heat transfer plate 21 is joined with the lower heat transfer plate 23 except for a first part (section) 34 and a second part (section) 35. The parts 34, 35 of the central openings that are not joined are defined by a respective angle $\alpha$ (the angle $\alpha$ is shown only for the second part 35). The parts 34, 35 are arranged symmetrically opposite each other and form the fluid inlet 34 for the first fluid F1 and fluid outlet 35 for the first fluid F1. Optionally, the plates 21, 23 are not joined at their central openings 31. Then the openings 45, 46 in the separation device 40 limit a flow of the first fluid F1, such that the fluid enters and exits the plates at the fluid inlet 34 and fluid outlet 35. The openings 45, 46 of the separation device 40 then subtends a respective angle $\alpha°$.

The central opening 31 of the heat transfer plate 21 is along its full length joined with a corresponding central opening of the upper heat transfer plate 22. The interspace between the plates 21, 22 forms part of the second flow path 12 for the second fluid F2.

The heat transfer plate 21 may also be partly joined with the lower heat transfer plate 23 at the periphery 39 of the heat transfer plate 21, i.e. the periphery 39 of the heat transfer plate 21 is partly joined with a similar periphery of the upper heat transfer plate 22. A first part (section) 36 and a second part (section) 37 of the periphery 39 are not joined with the upper heat transfer plate 22. The parts 36, 37 that are not joined are defined by a respective angle of $\beta$ degrees. The parts 36, 37 are symmetrical and are arranged opposite each other, and form the afore mentioned first side 36 that acts as a fluid entry for the second fluid F2, and the second 37 side that acts as a fluid exit 37 for the second fluid F2. It is not necessary to join the heat transfer plates 21, 22 at their peripheries. In this case the first side 36 still acts as a fluid entry 36 for the second fluid F2 and the second 37 side as a fluid exit 37 for the second fluid F2, even though some of the second fluid F2 might enter and exit the plates at sections outside the indicated sides 36, 37 of the plates.

To prevent too much of the second fluid F2 to pass the plate stack 20 by flowing e.g. in a possible gap between the cylindrical shell 3 and the plate stack 20, gaskets or some other by pass blocker (not shown) may be arranged between the shell 3 and the plate stack 20. These gaskets or blockers should be located beyond the fluid entry 36 and the fluid exit 37.

The joining of the heat transfer plates 21, 22, 23 is typically accomplished by welding. The heat transfer plate 21 may have a central edge 52 that is folded towards and joined with a corresponding folded, central edge of the lower adjacent heat transfer plate 23. The heat transfer plate 21 may also have a peripheral edge 51 that is folded towards and joined with a corresponding folded, peripheral edge of the upper adjacent heat transfer plate 22.

The heat transfer plates 21, 22, 23 may then be joined to each other at their folded edges. A seal may be arranged between the separation device 40 and the heat transfer plates for sealing plates like plates 21 and 23 along their central openings 31 at all sections but at the inlet 34 and the outlet 35. A seal may also be arranged between the cylindrical shell 3 and the heat transfer plates for sealing plates like plates 21 and 22 along their peripheries 39 at all peripheral sections but at the inlet 36 and the outlet 37.

Turning back to FIGS. 1-4 the flow over the heat transfer plates may be seen. The flow of the first fluid follows the path indicated by "F1". By virtue of the separation device 40 and its flow divider 42, the flow of the first F1 fluid passes the first fluid inlet 6, enters the first cylinder section 43 and flows out through the first opening 45 in the separation device 40, into first plate inlets 34 of the heat transfer plates 21 in the stack 20. The first fluid F1 then "turns around" when it flows across the heat transfer plates, as indicated by the path F1 in FIG. 1, leaves the heat transfer plates via first plate outlets 35 of the heat transfer plates 21 in the stack 20 and enters the second cylinder section 44 via the second opening 46. From the second cylinder section 44 the first fluid F1 flows to the first fluid outlet 7 where it leaves the heat exchanger 1.

The flow of the second fluid follows the path indicated by "F2". The flow of the second fluid F2 passes the second fluid inlet 8 and into second plate inlets 36 of the heat transfer plates 21 in the stack 20. For facilitating distribution of the fluid into all second plate inlets 36 of the heat transfer plates, the heat exchanger 1 may at the second fluid inlet 8 comprise a distributor that is formed as a channel between the shell 3 and the plate stack 20. This distributor, or channel, may accomplished by arranging a cut out 28 (see FIG. 1) in the heat transfer plate 21, such that a space is created between the heat transfer plate 21 and the shell 3 at the inlet 8. In a similar manner may a collector that has a similar shape as the distributor be arranged at the second fluid outlet 7. The collector is then formed as a channel between the shell 3 and the plate stack 20, and may be accomplished by arranging a cut out 29 in the heat transfer plate 21, such that a space is created between the heat transfer plate 21 and the shell 3 at the outlet 9. The first side 36, or fluid entry 36 of the heat transfer plate 21 is then formed in the cut out 28, and the second side 37, or fluid exit 37 is then formed in cut-out 29.

When the second fluid F2 has entered the fluid entries 36 of the plates it flows across the plates in the stack 20, see path F2 in FIG. 1, leaves the heat transfer plates in the stack 20 via the fluid exits 37 and thereafter leaves the heat exchanger 1 via the second fluid outlet 9.

With further reference to FIG. 8, it may be seen that an outer dimension D1 of the plate stack 20 is smaller than an inner dimension D2 of the shell 3. A gap 50 is then formed between the shell 3 and the plate stack 20. A first fluid blocker 51 and a second fluid blocker 52 are arranged in the gap 50 between the shell 3 and the plate stack 20. The fluid blockers 51, 52 reduce a flow of the second fluid F2 in the gap 50. A third fluid blocker 53 is arranged, as seen in a flow direction of the second fluid F2, before the first fluid blocker 51. A fourth fluid blocker 54 is arranged, as seen in a flow direction of the second fluid F2, before the second fluid blocker 52. The four fluid blockers 51-54 are typically of the same type.

The first fluid blocker 51 has an elongated form and extends in a direction from the top cover 4 to the bottom cover 5, and is arranged between the first sides 36 and the second sides 37 of the heat transfer plates 21-23, on a first side 61 of the plate stack 20. The second fluid blocker 52 has also an elongated form and extends in the direction from the top cover 4 to the bottom cover 5, and is arranged between the first sides 36 and the second sides 37 of the heat transfer plates 21-23, but on a second side 62 of the plate stack 20 that is opposite the first side 61 of the plate stack 20.

Specifically, the first fluid blocker 51 and the second fluid blocker 52 are located closer to the second sides 37 of the heat transfer plates 21-23 than to the first sides 36 of the heat transfer plates 21-23. The first fluid blocker 51 may be located less than 20 cm, or less than 10 cm, from a first edge 371 of the second sides 37 of the heat transfer plates 21-23. The second fluid blocker 52 may be located less than 20 cm, or less than 10 cm, from a second edge 372 of the second sides 37 of the heat transfer plates 21-23.

A first elongated guider 101 and a second elongated guider 102 are arranged in the gap 50 between the shell 3 and the plate stack 20, just before the fluid blockers 51-54, as seen in a direction of a flow of the second fluid F2. The guiders 101, 102 reduce movement of the plate stack 20 towards the shell 3. The guiders 101, 102 may also be arranged after the fluid blockers 51-54, as seen the direction of the flow of the second fluid F2. For reducing movement even further, four more guiders 103-106 are arranged in the gap 50 between the shell 3 and the plate stack 20. The guiders 101-106 have a respective dimension that is slightly smaller than the width of the gap 50, and extends along the plate stack 20, in a direction from the top cover 4 to the bottom cover 5. They are fixed to the any of the shell 3, the top cover 4, the bottom cover 5 and the plate stack 20.

With further reference to FIGS. 9 and 10, FIG. 9 shows the first fluid blocker 51 from above while FIG. 10 shows a partial side view of the first fluid blocker 51 together with a part of the bottom cover 5. The first fluid blocker 51 has a pipe shaped support member 511. The support member 511 may have other shapes just as well, such as a rectangular profile or the profile of an I-beam. A first gasket 512 extends from the support member 511 and into contact with the shell 3, and a second gasket 513 extends from the support member 511 and into direct or indirect contact with the plate stack 20. The second gasket 513 is in indirect contact with the plate stack 20 when e.g. a peripheral sheet 73, 74 is arranged around the plate stack 20 (see FIG. 11).

The gaskets 512, 513 have the form of a respective flexible, metal sheet 512, 513. The metal sheets 512, 513 are pressed together in a direction towards each other when the first fluid blocker 51 is arranged between the shell 3 and the plate stack 20. This results in that the flexible, metal sheets 512, 513 apply a force against the shell 3 and the plate stack 20, which efficiently seals the gap 50. The first fluid blocker 51 is arranged such that the gaskets 512, 513 extend from the support member 511, and in a direction towards the flow of the second fluid. Together the gaskets 512, 513 have a V-form or U-from (if bent), where the base of the V or the U is connected to the support member 511. The first fluid blocker 51 has a stiffener element 515 that is arranged on and along the support member 511, on a side 518 of the support member 511 that is opposite a side 519 from which the first gasket 512 and the second gasket 513 extend from. The gaskets 512, 513 may be attached to the support member 511 via an attachment rib 514.

Turning back to FIG. 8, the support member 511 of the first fluid blocker 51 is arranged between two guide elements 71, 72 that extend in a direction from the top cover 4 to the bottom cover 5. The guide elements 71, 72 are attached to the shell 3 or, directly or indirectly, to a periphery 201 of the plate stack 20. The guide elements 71, 72 are in indirect contact with the plate stack 20 when e.g. a peripheral sheet 73, 74 is arranged around the plate stack 20 (see FIG. 11). The guide elements 71, 72 may then be welded to the peripheral sheet 73, 74. Similar guide elements may be arranged around corresponding support members of the other fluid blockers 52-54.

The underside of the support member 511 has a protrusion 516 that extends into an opening 501 in the bottom cover 5. Optionally or alternatively, the upper side of the support member 511 has a similar protrusion that extends into an opening in the top cover 4. As similar protrusion 517 is arranged on the stiffener element 515 and extends into another opening 502 in the bottom cover 5. The top of the stiffener element 515 may have a similar protrusion that extends into another opening in the top cover 4. One or more of these protrusions provide lateral support for the first fluid blocker 51. The various parts of the first fluid blocker 51 may attached to each other by welding, or by any other, suitable technique.

Figure 11:
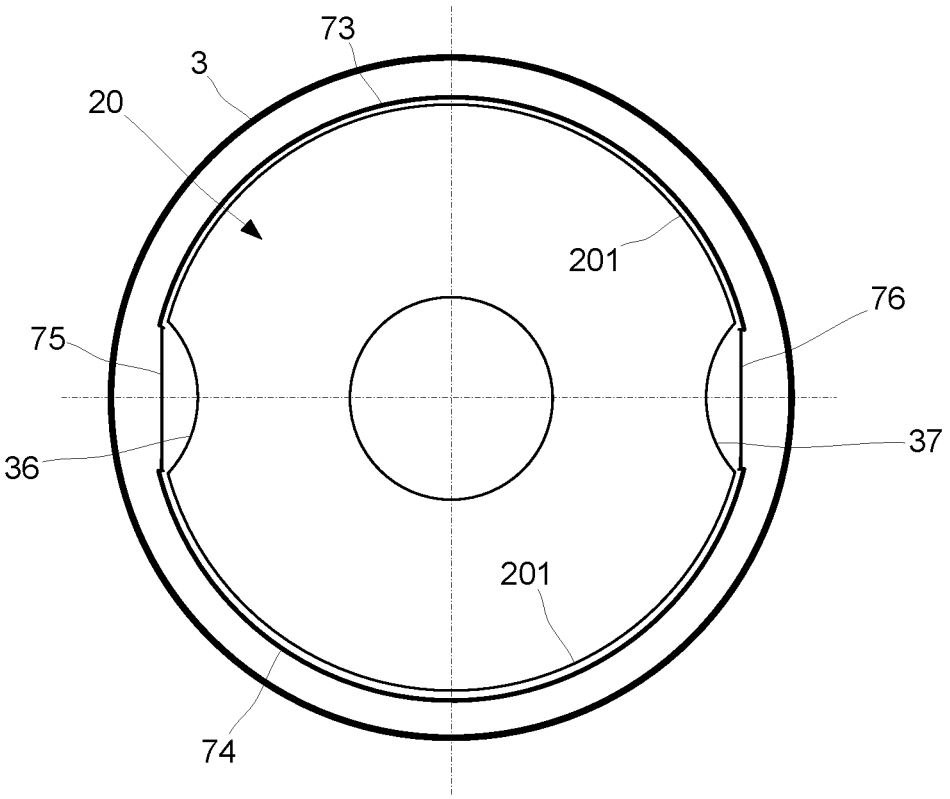
FIG. 11 is a cross-sectional top view of a central-port plate heat exchanger, as seen along line B2-B2 in FIG. 2, showing a peripheral sheet that is arranged around a plate stack.

With further reference to FIG. 11 the heat exchanger 1 has a peripheral sheet 73, 74 that is arranged around the plate stack 20. In detail, the peripheral sheet has a first part 73 and second part 74 that are joined to each other by connection wires 75, 76 that pull the two parts 73, 74 towards each other, such that they fit snugly to the periphery 201 of the plate stack 20. Other elements than connection wires may be used for this, as long as they pull the two parts 73, 74 towards each other. By virtue of the wires, the periphery 201 of the plate stack 20 is not covered at the first and second sides 36, 37, which allows the sided 36, 37 to act fluid entries and fluid exits for the second fluid F2.

Figure 12:
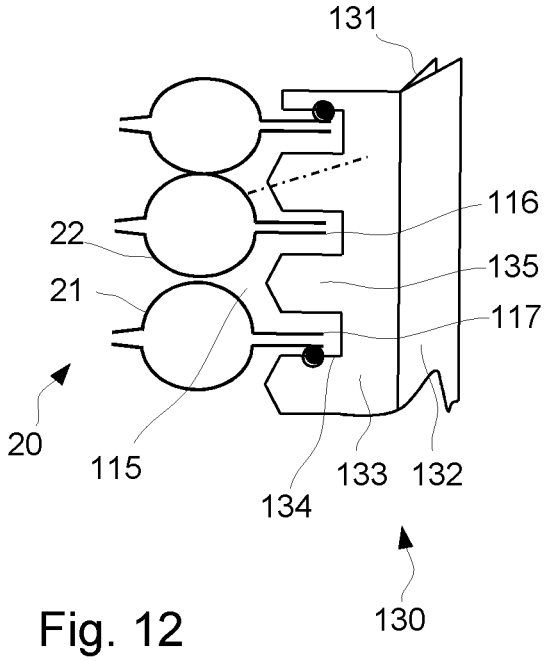
FIG. 12 is principal views that illustrate a second embodiment of a fluid blocker that may be used for the heat exchanger of FIG. 1.

With reference to FIG. 12 a second embodiment of a fluid blocker 130 is illustrated. This fluid blocker 130 is has an elongated base 133 with protrusions 135 that extend into gaps 115 between the heat transfer plates 21-22. The fluid blocker 130 is arranged between the shell 3 and the plate stack 20 and prevents the second fluid F2 from taking a short-cut between the heat transfer plates 20 and the inner surface of the shell 3. The fluid blocker 130 has a comb-like form and extends along the plate stack 20, from the top cover 4 to the bottom cover 5. Gaps 134 are located between the protrusions 135 into which the edges 117 of the heat transfer plates in the plate stack 20 extends, and may be attached to the plate stack 20 by spot-welds. From the base 133 a first seal 131 and a second seal 132 extends. These seals, or gaskets 131, 132, are flexible such that they closely abut the interior surface of the shell 3 when the fluid blocker 130 with its sealing elements 131, 132 is arranged between the plate stack 20 and the cylindrical shell 11. The second embodiment of the fluid blocker 130 may replace one or all fluid blockers 51-54 shown in FIG. 7. The second embodiment of a fluid blocker 130 may replace some or all fluid blockers shown in FIG. 8. Generally, all fluid blockers are of the same type. All parts of the heat exchanger 1 may be made of metal.

From the description above follows that, although various embodiments of the invention have been described and shown, the invention is not restricted thereto, but may also be embodied in other ways within the scope of the subject-matter defined in the following claims.

The invention claimed is:

1. A plate heat exchanger comprising a casing that comprises a shell, and a top cover and a bottom cover that are connected to the shell to from an enclosure in the casing, a fluid separation device, a number of heat transfer plates that are joined to each other to form a plate stack that is arranged within the enclosure and has alternating first and second flow paths for a first fluid and a second fluid in between the heat transfer plates, the heat transfer plates having central openings that form a central space in the plate stack and in which the fluid separation device is arranged, such that a first part of the central opening may act as a fluid inlet and a second part of the central opening may act as a fluid outlet for the first fluid, first sides that act as a fluid entries for the second fluid, and second sides that are opposite the first sides and act as fluid exits for the second fluid, an outer dimension of the plate stack is smaller than an inner dimension of the shell, such that a gap is formed between the shell and the plate stack, and a first fluid blocker and a second fluid blocker are arranged in the gap between the shell and the plate stack, for reducing a flow of the second fluid in the gap.

2. A plate heat exchanger according to claim 1, wherein the first fluid blocker has an elongated form and extends in a direction from the top cover to the bottom cover and is arranged between the first sides and the second sides of the heat transfer plates, on a first side of the plate stack, and the second fluid blocker has an elongated form and extends in the direction from the top cover to the bottom cover and is arranged between the first sides and the second sides of the heat transfer plates, on a second side of the plate stack that is opposite the first side of the plate stack.

3. A plate heat exchanger according to claim 1, wherein the first fluid blocker and the second fluid blocker are located closer to the second sides of the heat transfer plates than to the first sides of the heat transfer plates.

4. A plate heat exchanger according to claim 1, wherein the first fluid blocker and the second fluid blocker are located less than 20 cm from a respective edge of the second sides that act as fluid exit for the second fluid.

5. A plate heat exchanger according to claim 1, wherein the first fluid blocker comprises a support member, a first gasket that extends from the support member into contact with the shell, and a second gasket that extends from the support member into direct or indirect contact with the plate stack.

6. A plate heat exchanger according to claim 5, wherein the gaskets have the form of a respective flexible, metal sheet, which metal sheets are pressed together in a direction towards each other when the first fluid blocker is arranged between the shell and the plate stack, the flexible, metal sheets thereby applying a force against the shell and the plate stack.

7. A plate heat exchanger according to claim 5, wherein the first fluid blocker comprises a stiffener element that is arranged on and along the support member, on a side of the support member that is opposite a side from which the first gasket and the second gasket extend from.

8. A plate heat exchanger according to claim 5, wherein the support member of the first fluid blocker is arranged between two guide elements that extend in a direction from the top cover to the bottom cover, and are attached to the shell or, directly or indirectly, to a periphery of the plate stack.

9. A plate heat exchanger according to claim 5, wherein the first fluid blocker comprises a protrusion that extends into an opening in the top cover or the bottom cover.

10. A plate heat exchanger according to claim 1, wherein a peripheral sheet is arranged around the plate stack, such that a periphery of the plate stack is, apart from at least the first and second sides that act fluid entries and fluid exits for the second fluid, covered by the peripheral sheet.

11. A plate heat exchanger according to claim 1, wherein the first fluid blocker comprises an elongated base that has protrusions that extend into gaps between the heat transfer plates.

12. A plate heat exchanger according to claim 1, comprising a gasket arrangement that is arranged between the fluid separation device and the central openings of the heat transfer plates.

13. A plate heat exchanger according to claim 12, wherein the gasket arrangement comprises a cover sheet that is arranged around the fluid separation device, such that a periphery of the fluid separation device is, apart from at least first and second openings in the fluid separation device, covered by the cover sheet, the openings of the fluid separation device facing the first part and the second part of the central opening that act fluid inlet and outlet for the first fluid.

14. A plate heat exchanger according to claim 13, wherein the gasket arrangement comprises at least one corrugated metal sheet that is arranged between the cover sheet and the fluid separation device, for pressing the cover sheet against the central openings of the heat transfer plates.

15. A plate heat exchanger according to claim 1, comprising a first elongated guider and a second elongated guider that are arranged in the gap between the shell and the plate stack, for reducing movement of the plate stack towards the shell.

* * * * *